US006511207B2

(12) United States Patent
Limber et al.

(10) Patent No.: US 6,511,207 B2
(45) Date of Patent: Jan. 28, 2003

(54) LIGHTED LETTER PANEL

(76) Inventors: Jamie A. Limber, 1059 W. Vaughn, Gilbert, AZ (US) 85233; Brian R. Freeland, 2139 W. Isthmus Loop, Mesa, AZ (US) 85202; Daniel J. Dick, 15202 N. 28$^{th}$ Dr., Phoenix, AZ (US) 85023

( * ) Notice: Subject to any disclaimer, the term of this patent is extended or adjusted under 35 U.S.C. 154(b) by 0 days.

(21) Appl. No.: 09/776,827

(22) Filed: Feb. 5, 2001

(65) Prior Publication Data

US 2001/0053083 A1 Dec. 20, 2001

Related U.S. Application Data

(63) Continuation-in-part of application No. 29/124,932, filed on Jun. 14, 2000.

(51) Int. Cl.$^{7}$ ..... F21S 13/14

(52) U.S. Cl. ..... 362/252; 362/432; 362/806; 40/452; 40/550

(58) Field of Search ..... 362/252, 565, 362/806, 432, 812, 249, 7, 808; 40/452, 550

(56) References Cited

U.S. PATENT DOCUMENTS

| | | | | | |
|---|---|---|---|---|---|
| 5,555,163 | A | | 9/1996 | Pisani | 362/252 |
| 5,628,557 | A | * | 5/1997 | Huang | 362/252 |
| 5,709,462 | A | | 1/1998 | Rumpel | 362/249 |
| 5,813,747 | A | | 9/1998 | Kale | 362/123 |
| 6,056,419 | A | * | 5/2000 | March | 362/249 |
| 6,260,987 | B1 | * | 7/2001 | Wu | 362/147 |

* cited by examiner

*Primary Examiner*—Sandra O'Shea
*Assistant Examiner*—John Anthony Ward
(74) *Attorney, Agent, or Firm*—The Halvorson Law Firm

(57) ABSTRACT

The present invention is a device that functions as a letter display panel 1. The display panel 1 is a body 2 that is a relatively thin piece of material having front and rear surfaces 4 and 6 with an edge 5 that extends between the front and rear surfaces, 4 and 6. In a preferred embodiment, a kit having a plurality of identical display panels 1 is provided for use with ornamental light strings. Each separate display panel 1 is capable of forming an individual lighted letter when used with the ornamental light string, as will be described below. The separate display panels 1 may be then coupled together to form written messages and the like.

13 Claims, 8 Drawing Sheets

LIGHTED LETTER PANEL

This application is a continuation-in-part of pending application Ser. No. 29/124,932, filed on Jun. 14, 2000, entitled "Lighted Letter Panel".

FIELD OF THE INVENTION

The present invention relates to the field of ornamental light strings. More specifically, the present invention is a device useful for creating letters or written messages using ornamental light strings and the like.

BACKGROUND

It can be appreciated that holiday decorating has become a popular activity. The number of houses and businesses in any given urban area that actively decorate exterior surfaces is increasing at a significant rate. Indeed, in many areas, neighbors and neighborhoods participate in decorating contests, where individual neighbors or neighborhoods attempt to create the most aesthetically pleasing display.

Currently, the primary component in building or outdoor displays lies with ornamental light strings. These are light strings have a plurality of individual light elements electrically connected either in-series or in-parallel. These ornamental light strings are usually attached to edges of buildings or windows to create an outline effect. Other effects are the spiral encirclement of a tree or other vertical object, or extensions across surfaces to create a lined or gridded effect. Recently, there have been efforts to create additional effects with light strings, such as the currently popular "icicle" light strings, which hang vertically from an edge to create the illusion of icicles hanging from the eaves in the winter.

One problem with holiday decorating has been the inability to easily and conveniently create written messages. A typical user creates a written message by either focusing a spotlight on a board containing the written message or by laboriously laying a light string out in the form of letters and stapling, or otherwise fastening, the light strings to a background. Neither of these methods is convenient and easy to create, thereby making the use of written messages in the decorating schemes available only to a dedicated few.

There have been a few attempts at creating display devices for creating convenient letters. See for example U.S. Pat. Nos. 5,555,163; 5,709,462; and 5,813,747. These devices, however, are fairly complex and do not solve all of the problems associated with the easy and convenient creating of lighted written messages. Thus, they have not found commercial success. Therefore, there is a present and continuing need for devices that allow the easy and convenient creating of lighted written messages used in holiday decorations.

SUMMARY OF THE INVENTION

It is an object of the present invention to provide a device that allows the easy and convenient creating of lighted written messages.

It is another object of the present invention to provide a device wherein individual elements of an ornamental light string may be arranged to form a discrete letter.

It is yet another object of the present invention to provide a device that forms individual letters using ornamental light strings and further where several of these devices may be connected to form written messages or communications.

It is still yet another object of the present invention to provide a letter display device that may be mounted onto a property or surface, such as yards, buildings, fences, and the like, wherein the letter display forms illuminated letters by the appropriate insertion of individual light elements of an ornamental light string into specified apertures of a plurality of apertures.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

The present invention is useful for the easy and convenient creation of illuminated letters or written messages used in holiday decorating. Herein, the terms "letters" and "written messages" may include numerals or other symbols.

Figure 1:
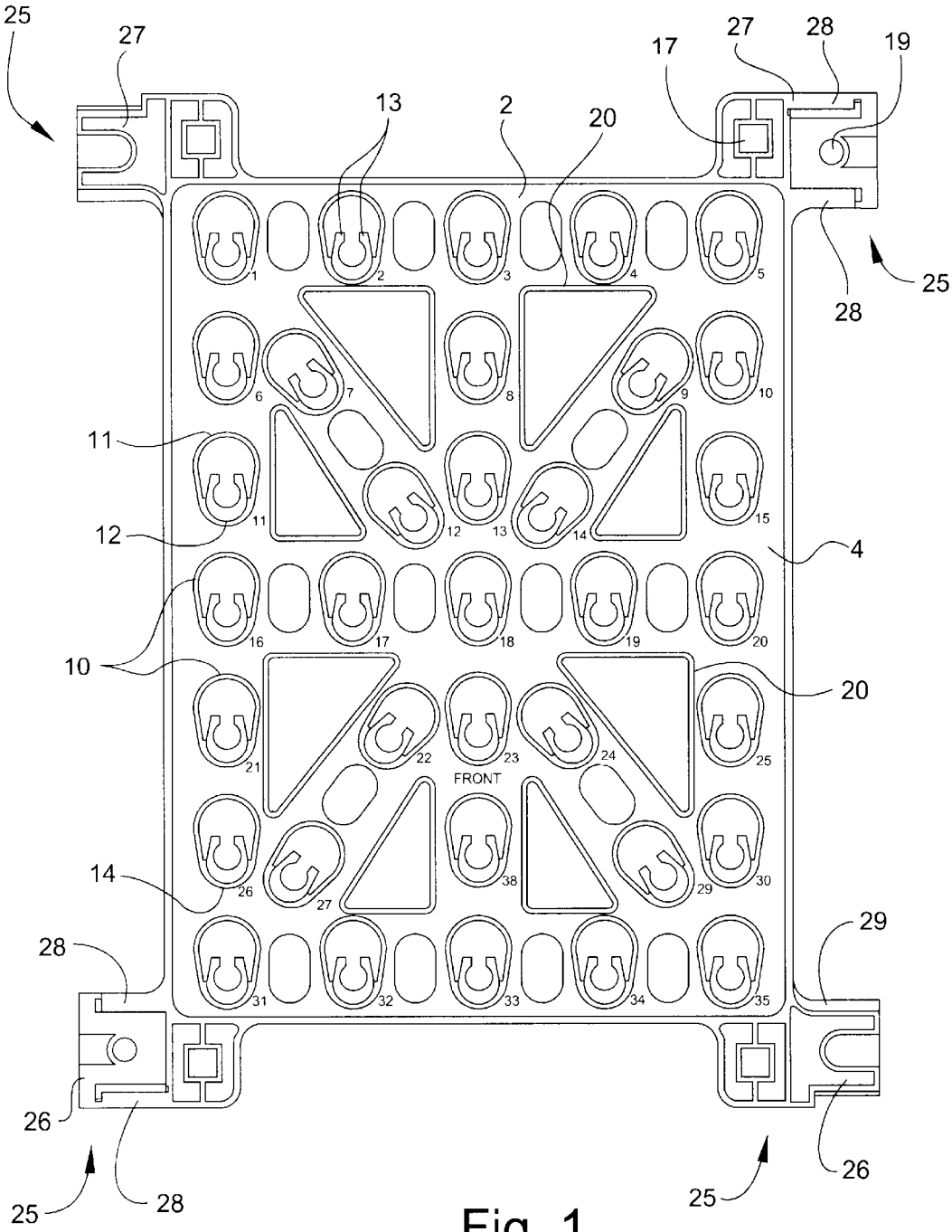
FIG. 1. is a front view of the panel, according to the present invention.
Figure 2:
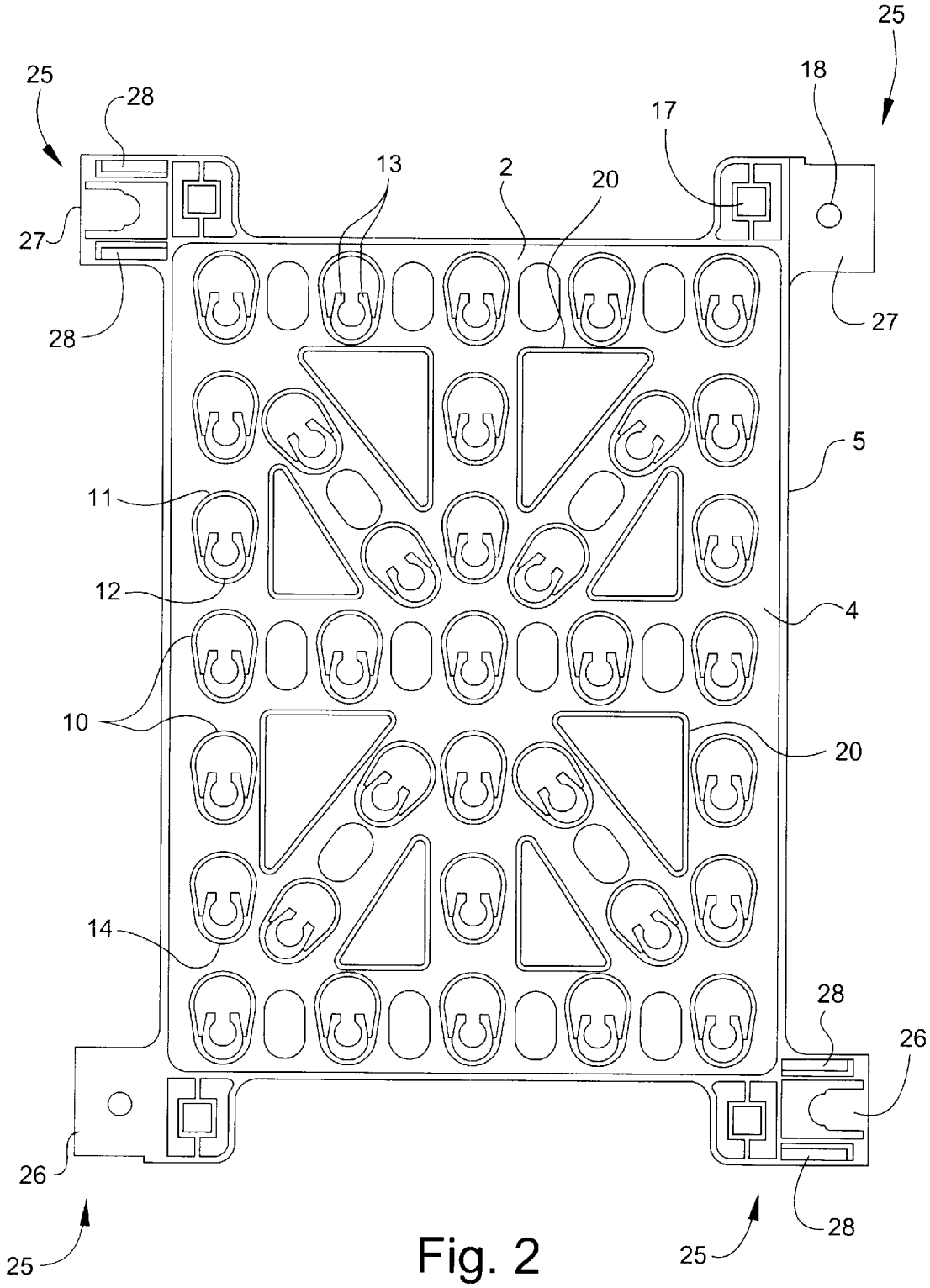
FIG. 2. is a rear view of the panel, according to the present invention.
Figure 3:
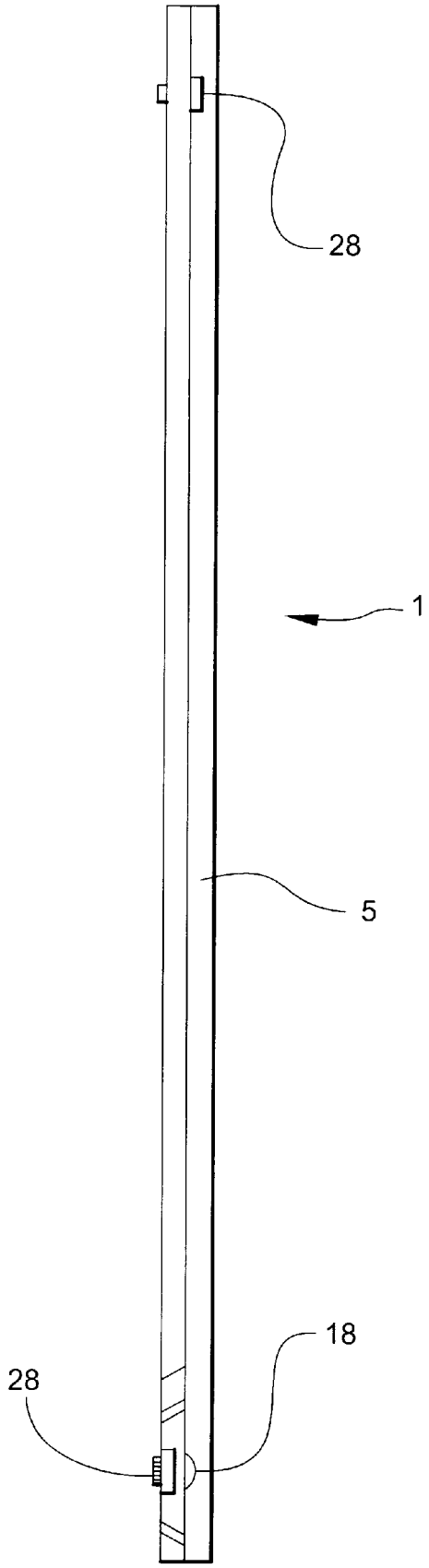
FIG. 3. is a side view of the panel, according to the present invention.

The present invention is a device that functions as a letter display panel 1, FIGS. 1–3. The display panel 1 is a body 2 that is a relatively thin piece of material having front and rear surfaces 4 and 6 with an edge 5 that extends between the front and rear surfaces, 4 and 6. In a preferred embodiment, a kit having a plurality of identical display panels 1 is provided for use with ornamental light strings. Each separate display panel 1 is capable of forming an individual lighted letter when used with the ornamental light string, as will be described below. The separate display panels 1 may be then coupled together to form written messages and the like.

In a preferred embodiment, the body 2 of the display panel 1 is generally rectangular in shape, though other shapes may be used and still fall within the scope of the present invention. Located in the display panel 1, and extending between the front and rear surfaces 4 and 6, is a plurality of apertures 10. In one embodiment each of the plurality of apertures 10 has a "key-hole" shape, where the shape is elongated with a first end and a second end, 11 and 12. The diameter of the first end 11 is larger than the diameter of the second end 12. Where the two diameters meet, there is a narrowing of the aperture 10, said narrowing creates projections 13 that hold light elements securely in place. Additionally, located at the second end 12 is a support projection 14, which projects from both the front and rear surface, 4 and 6, that helps hold each individual light element in place. Alternately, the apertures 10 may have a "horseshoe" holding tab, FIG. 8, having two mirror image prongs, contained therein. The space defined by the two prongs is generally rectangular in shape to accommodate the light elements of the most popular style of light strings.

In use, a light element is inserted into the large diameter of the first end 11 of the aperture 10, and forced past the projections 13, or two prongs, into the smaller diameter of the second end 12, or space. Thus, it can be seen that the diameter of the first end 11 needs to be at least as large as the largest diameter of a light element to be inserted, and the diameter of the second end 12 should be approximately the same diameter of at least a portion of the light element.

Figure 7:
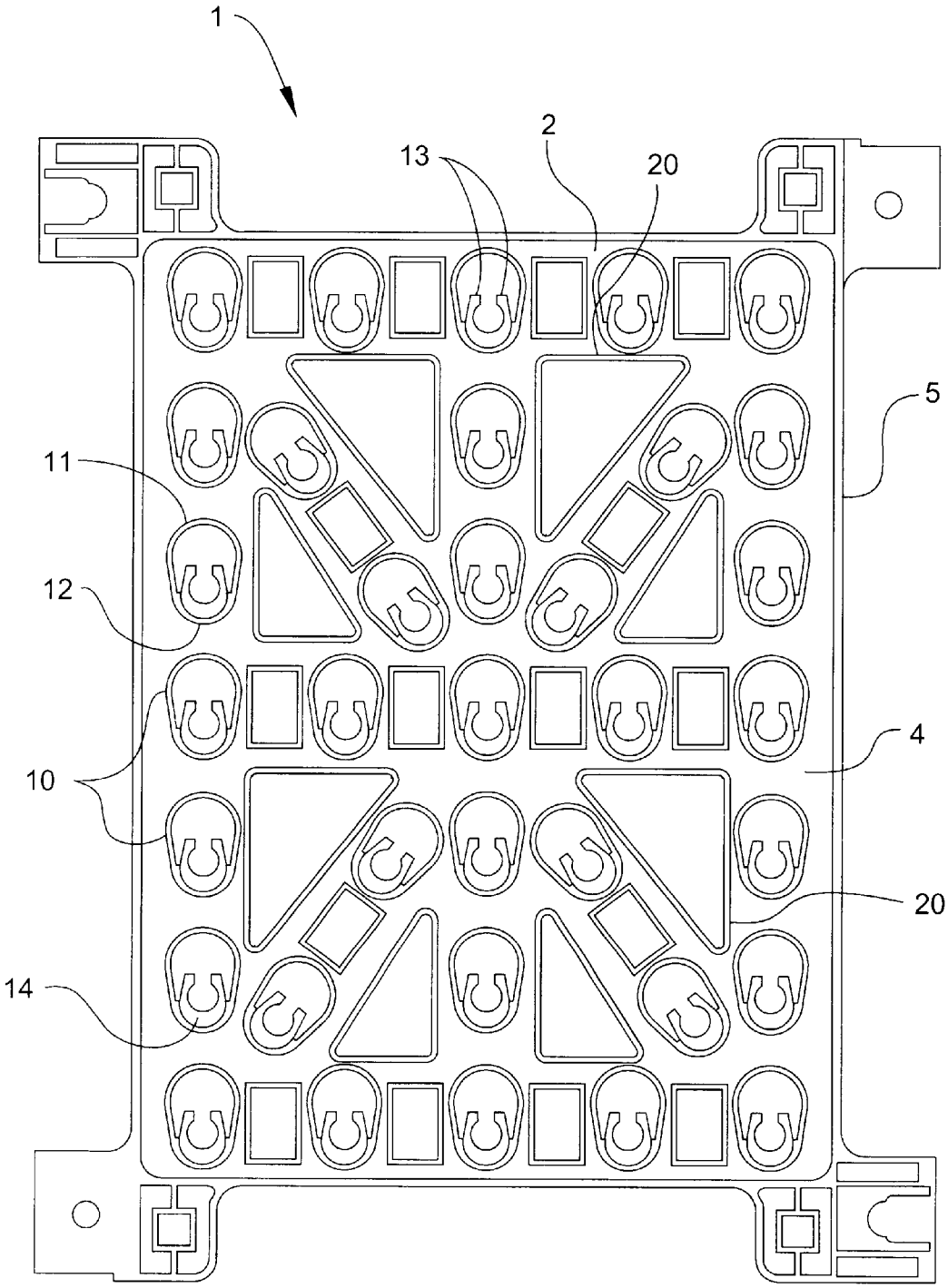
FIG. 7. is an alternate embodiment of the panel according to the present invention.

The plurality of apertures 10 is positioned in the body 2 in an array. In one embodiment, the array may be a regular grid array. Another embodiment has the array is arranged as concentric circles. However, the preferred embodiment of the present invention, illustrated in FIGS. 1, 2, and 7, has the array in a generally rectangular outline, with rows of apertures 10 extending between corners of the body 2 and between centers of sides of the body 2. This is a form of a regular grid array with some of the elements displaced. If we take the array illustrated in FIG. 1 as an example and equate it to a 7×5 matrix, where the first element of the matrix is a row number and the second element of the matrix is a column number, then those apertures 10 located at the (2,2), (2,4), (3,2), (3,4), (5,2), (5,4), (6,2), and (6,4) locations are displaced. More specifically, the apertures 10 located at (2,2), (2,4), (6,2), and (6,4) are displaced horizontally outward away from the center of the body 2 and the elements located at (3,2), (3,4), (5,2), and (5,4) are displaced horizontally inward toward the center of the body 2. This specific configuration has been found to best create all of the letters and numbers of alphabets used by many languages in the world.

The body 2 of the display panel 1 may also have at least one opening 20, preferably a plurality of openings that extend between the front and rear surfaces, 4 and 6. In a preferred embodiment, illustrated in FIG. 1 and 2, these openings 20 are generally triangular is shape and located in the enlarged areas created by the displacement of certain apertures 10 described above. These opening 20 serve several purposes. The openings 20 reduce the amount of material needed in the manufacture of each display panel 1, but more importantly, they create areas where the viewer sees the background instead of lighted display panel surface, 4 or 6. This is important since the contrast that is created magnifies the apparent illumination created by individual light elements, thereby enabling the use of less bright, and therefore cooler, light elements. Additionally, the openings 20 allow wind and weather to penetrate and flow through the display panels 1, thereby making the display panels 1 more stable in all weather conditions. Further, the openings allow the user to easily see the position of his/her hand behind the display panels 1 when attaching the light strings to the display panels 1. In an alternate embodiment, shown in FIG. 7, there are also a series of square apertures that further aid in contrast and reduction of manufacturing costs.

In order to provide assemblability, each display panel 1 has four tabs 25, one attached to each corner of the body 2 of the display panel 1, respectively. One of each bottom and top tabs, 26 and 27, has at least two slide projections 28, preferably two as illustrated in FIG. 2. Each slide projection 28 extends from the tab 25 and projects enough to hold a thin piece of material, such as plastic, between the tab 25 and the projection 28. The remaining tabs are sized to be removeably received between the two slide projections 28. In a preferred embodiment, as illustrated in FIG. 1, diagonal corners of the body 2 of the display panel 1 have tabs 25 with projections 28. The tabs 25 without projections 28 of one display panel 1 are inserted between the tabs 25 and projections 28 of an adjacent display panel 1 to removably secure the multiple panels 1 together. The tabs 25 without projections 28 further have beveled edges 29 that fit into complementary bevels in the projections 28 (not shown). Finally, the tabs 25 with projections 28 further have a detent 19 that is generally centrally located between the projections 28. The tabs 25 without projections 28 have a button 18 that is located such that is may be received by the detent 19 when adjacent panels 1 are assembled. This feature allows for multiple panels 1 to be connected and thereby create words and phrases spelled out by the individual letter display panels 1. It is important to note that the present design allows the display panels 1 to be secured in a variety of different orientations, such as horizontally, vertically, diagonally, and combinations thereof.

The display panels 1, according to the present invention, may be mountable to surfaces such as the ground, grass, snow cover, a roof, or the like. Thus, the panel 1 may further have at least one, preferably four, mounting apertures 17 that are arranged to receive nails, screws, or other attachment devices.

Figure 4:
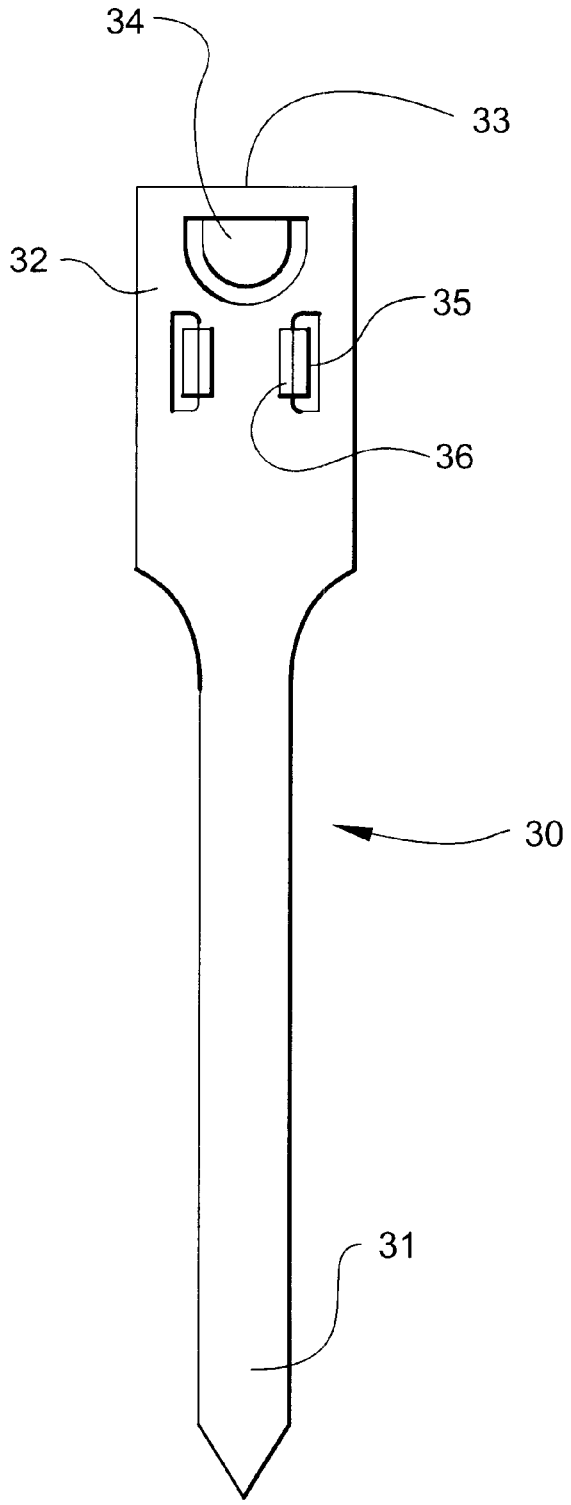
FIG. 4. is a front view of a mounting support, according to the present invention.
Figure 5:
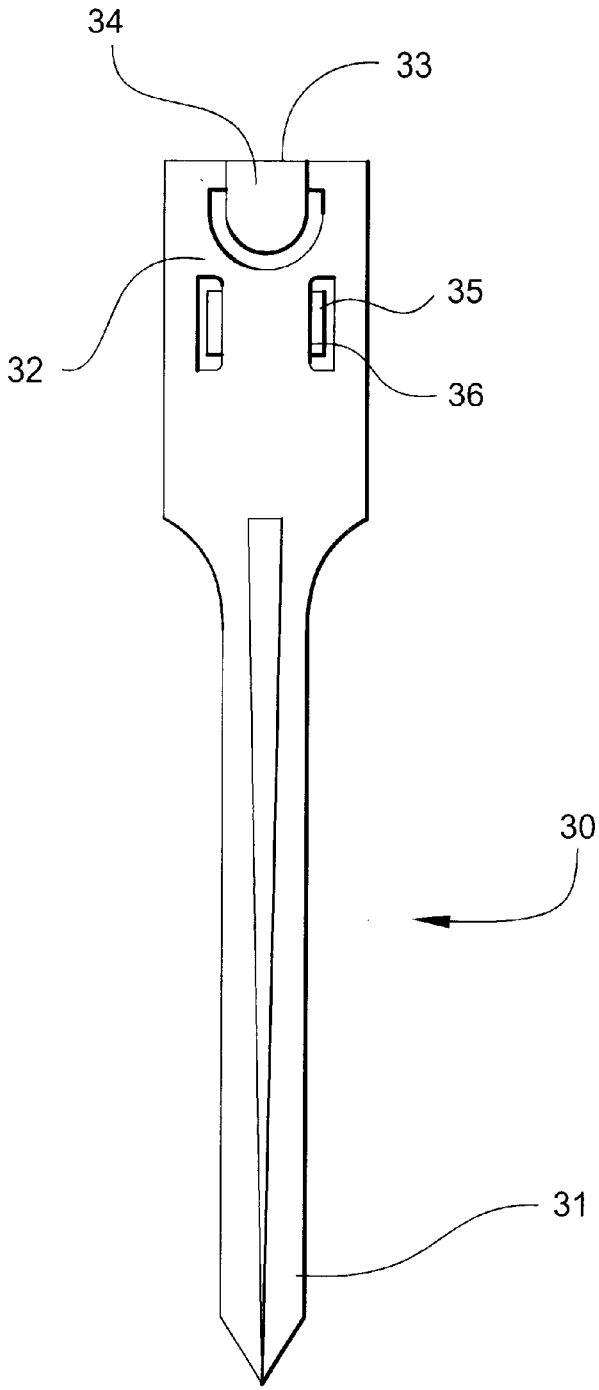
FIG. 5. is a rear view of the mounting support, according to the present invention.
Figure 6:
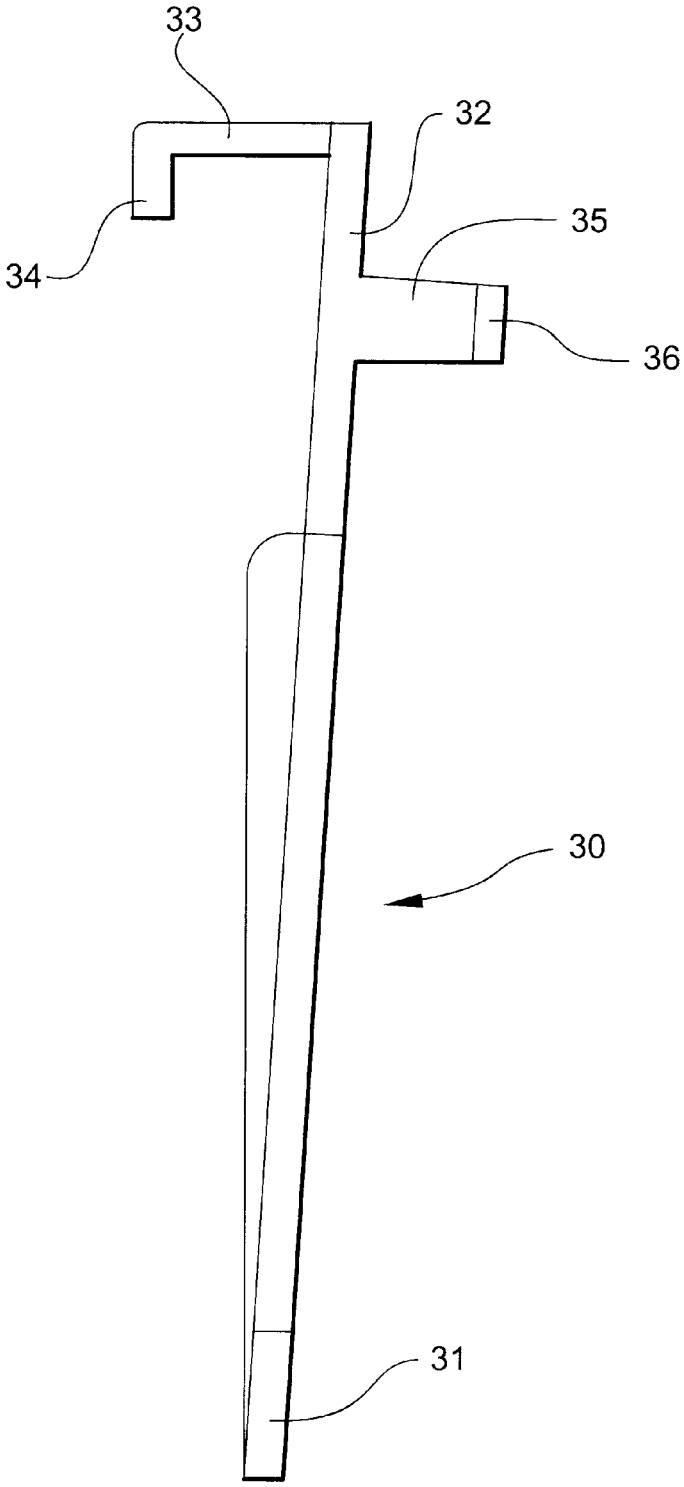
FIG 6. is a side view of the mounting support, according to the present invention.

In the preferred embodiment, the present invention includes at least one mounting support 30, preferably two. In a preferred embodiment, illustrated in FIGS. 4–6, the mounting support 30 is elongated with a first end 31 that is pointed and substantially flat. There is a second end 32 that is primarily flat, but has associated projections. This configuration allows the first end 31 of the mounting support 30 to be driven into the ground or snow cover in a freestanding spike configuration. There is a first projection 33 that has a generally L-shaped cross section with a long leg that extends from the second end 32 and the short leg 34 projects in the direction of the first end 31. The first projection 33 allows the mounting support to be hung on horizontal supports such a building fascia and the like. There are also a pair second projections 35 that extend from the side opposite that of the first projection 33. The second projection 35 have a thickened distal end 36 for insertion into the tabs 25 of the panel 1. The pair of distal projections 35 are specifically designed to be received by the mounting apertures 17 located in the panel 1.

In one configuration, the mounting support 30 is attached to the mounting apertures 17 located on a bottom side of the panel body 2. In this configuration, the supports 30 may be inserted into the ground or snow cover to stabilize and secure the panel 1. In an alternate configuration, the mounting support 30 is attached to the mounting apertures 17 located on a top side of the panel body 2. In this configuration, the supports 30 may be attached or otherwise hung from a surface, such as a building facia.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A display panel for use with ornamental light strings comprising

Figure 8:
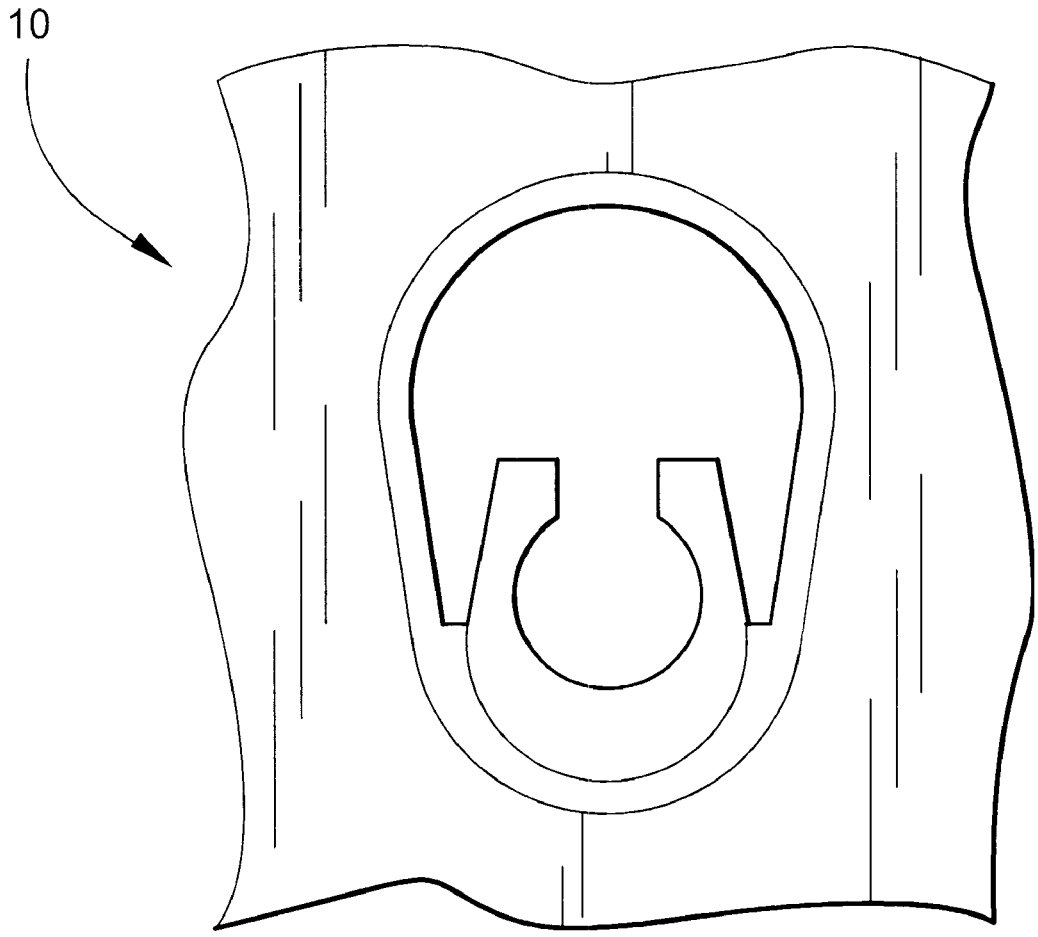
FIG. 8. is an alternate embodiment of the apertures according to the present invention.

A. a body having a front surface and a rear surface with an edge that extends between the front and rear surfaces, B. said body having a plurality of FIG. 8 shaped apertures that extend between the front and rear surfaces and that are positioned in an array, C. each of said plurality of FIG. 8 shaped apertures having a first end and a second end, the second end having a smaller diameter than that of the first end.

2. The display panel according to claim 1 wherein each aperture of the plurality of apertures includes a support projection located adjacent the second end and that extends perpendicular to both the front and rear surfaces, whereby the support projection helps hold inserted light elements in place.

3. The display panel according to claim 2 where the array of apertures is a 7 row by 5 column array.

4. The display panel according to claim 3 further including at least one opening that is located within the array of the plurality of apertures.

5. The display panel according to claim 1 wherein each aperture of the plurality of apertures includes a holding tab having two mirror image prongs.

6. The display panel according to claim 5 where the array of apertures is a 7 row by 5 column array.

7. The display panel according to claim 6 further including at least one opening that is located within the array of the plurality of apertures.

8. The display panel according to claim 1 further including four tabs, for interconnecting different display panels, attached to each corner of the body of the display panel.

9. The display panel according to claim 8 wherein each of two of the four tabs have snap projections and each of the remaining two of the four tabs have voids that are capable of snuggly and removably receiving a snap projection.

10. The display panel according to claim 9 wherein the tabs having snap projections are located on diagonal corners and the tabs having voids are located on the remaining diagonal corners.

11. The display panel according to claim 1 further including, in combination, at least two display panel mounting supports having apertures that are capable of receiving one of at least two support hooks that are attached to edges of the body.

12. The display panel according to claim 11 wherein the support hooks are L-shaped projections.

13. The display paned according to claim 11 wherein the support hooks are barbed projections.

* * * * *